US005307542A

United States Patent [19]

Murai

[11] Patent Number: 5,307,542

[45] Date of Patent: May 3, 1994

[54] BUCKLE FOR ADJUSTABLY SECURING A BELT OR THE LIKE

[75] Inventor: Ryuichi Murai, Toyama, Japan

[73] Assignee: Yoshida Kogyo K.K., Tokyo, Japan

[21] Appl. No.: 54,238

[22] Filed: Apr. 30, 1993

[30] Foreign Application Priority Data

| | | | |
|---|---|---|---|
| Apr. 30, 1992 | [JP] | Japan | 4-28868[U] |
| Apr. 30, 1992 | [JP] | Japan | 4-28870[U] |
| May 29, 1992 | [JP] | Japan | 4-138195 |
| May 29, 1992 | [JP] | Japan | 4-138916 |

[51] Int. Cl.[5] ..... A44B 11/00

[52] U.S. Cl. ..... 24/200; 24/169; 24/197

[58] Field of Search ..... 24/200, 197, 198, 169

[56] References Cited

U.S. PATENT DOCUMENTS

| | | | |
|---|---|---|---|
| 2,649,637 | 8/1953 | Hodge | 24/200 |
| 4,525,901 | 7/1985 | Krauss | 24/200 |
| 4,571,783 | 2/1986 | Kasai | 24/200 |
| 4,637,099 | 1/1987 | Kasai | 24/200 |
| 4,677,711 | 7/1987 | Anscher . | |
| 4,843,689 | 7/1989 | Fildan | 24/200 |

FOREIGN PATENT DOCUMENTS

| | | |
|---|---|---|
| 9002434 | 8/1990 | Fed. Rep. of Germany . |
| 9102723 | 7/1991 | Fed. Rep. of Germany . |
| 63-110207 | 7/1988 | Japan . |
| 34203 | 1/1991 | Japan . |
| 2153000 | 8/1985 | United Kingdom . |

*Primary Examiner*—Victor N. Sakran

*Attorney, Agent, or Firm*—Hill, Steadman & Simpson

[57] ABSTRACT

A buckle has a pair of side flange portions interconnected in spaced relation by a plurality of transverse bars. A first anchoring bar and a second anchoring bar are held in spaced partially superimposed relation to each other to define therebetween a substantially "Z"-like path for wrapping therearound a web-like material or a belt. The belt is thereby firmly secured in place relative to the buckle after its length has been adjusted.

8 Claims, 10 Drawing Sheets

BUCKLE FOR ADJUSTABLY SECURING A BELT OR THE LIKE

BACKGROUND OF THE INVENTION

1. Field of the Invention

This invention relates to a buckle for adjustably securing a web-like material, typically a belt, for garments, bags, sports gear and the like.

2. Prior Art

There are known a variety of buckles including means for adjusting the length of their associated belts or straps to suit a particular application. Japanese Utility Model Laid-Open Disclosure No. 63-110207 discloses one example of such a prior buckle device which comprises a first side flange carrying a retainer bar and a second side flange carrying a winding bar with a stopper means, both flanges being pivotally connected to a transverse shaft, wherein the retainer bar is flipped back over the winding bar to retain belt therebetween. When the belt is thus retained under pressure, there will be a counter-acting force exerted by the belt against the buckle tending to spread the two bars apart, this being more likely due to the shaft bore being relatively large. Another drawback of this prior art buckle is that it is a two-piece structure requiring the winding bar portion to be separately fabricated, leading to increased production cost.

Another buckle of the known type is disclosed in Japanese Patent Publication No. 3-4203 in which there is shown a buckle having a first bar and a second bar with their respective confronting edges spaced apart a distance not greater than the thickness of a bell such that the belt is passed around the confronting edges along a path configuration is not distinct enough to ensure firm fixation of the belt relative to the buckle.

SUMMARY OF THE INVENTION

With the foregoing drawbacks of the prior art in view, the present invention seeks to provide an improved buckle which is capable of securing a belt or the like firmly in place against releasing movement after adjustment of its length.

The invention also seeks to provide an improved buckle which is relatively simple in construction and easy to manufacture to an integral structure having first and second belt anchoring bars defining therebetween a path which assumes a substantially "Z"-like cross-sectional configuration for the passage of a belt or the like.

The above and other objects and features of the invention will be better understood from the following detailed description taken in connection with the accompanying drawings which illustrate by way of example some preferred embodiments. Like reference numerals refer to like or corresponding parts throughout the several views.

According to the invention, there is provided a buckle for adjustably securing a belt or the like which comprises a generally frame-like body defined by side flange portions interconnected by a plurality of bars extending in parallel spaced relation transversely of the body, an end transverse bar connected to one end of the flange portions for securing one end of the belt, a first anchoring bar having an anchoring portion directed towards the one end of the body and a second anchoring bar having an anchoring portion, the first and second anchoring bars being held in spaced partially superimposed relation to each other with the anchoring portion of the second anchoring bar extending into the region of the first anchoring bar beyond a vertical axial line passing in contact with the anchoring portion of the first anchoring bar perpendicularly to the longitudinal plane of the body, thereby establishing a substantially cross-sectional "Z"-like path for wrapping therearound the opposite end of the buckle.

DETAILED DESCRIPTION OF THE INVENTION

Figure 1:
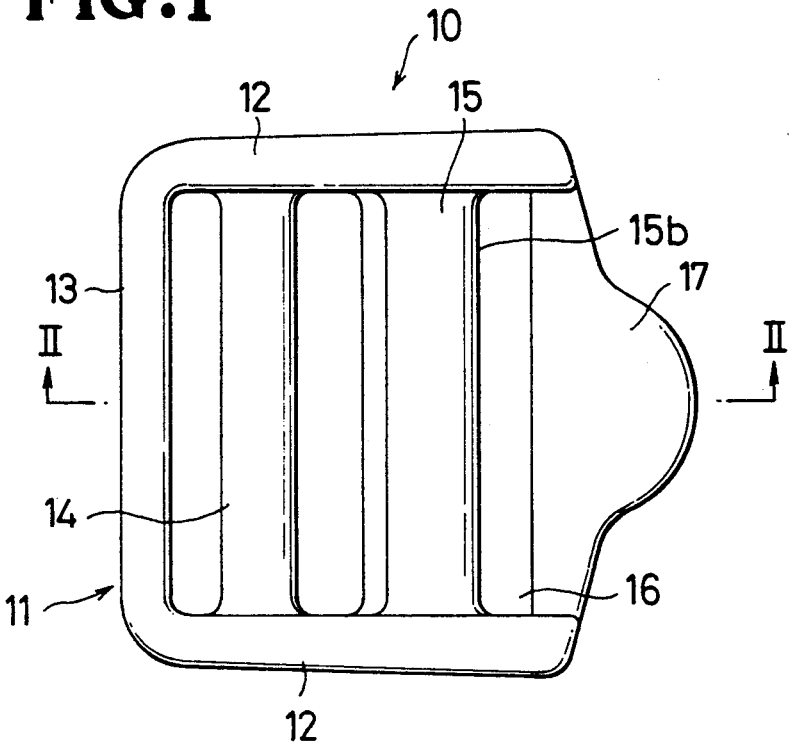
FIG. 1 is a plan view of a buckle according to a first embodiment of the invention.

Referring now to the drawings and FIG. 1 in particular, there is shown a buckle 10 according to a first embodiment of the invention which is made of a metallic material or a plastic material, the latter being preferred for expedient shaping by molding into a desired polygonal one-piece structure in a manner hereinafter to be described. The buckle 10 comprises a generally frame-like body 11 defined by side flange portions 12, 12 which are interconnected by a plurality of bars extending in parallel spaced relation transversely of the body 11. The flange portions 12, 12 have a thickness at one end 11*a* sufficient to accommodate two partially superimposed anchoring bars later described and taper progressively towards the opposite end 11*b* of the a buckle of the invention body 11 as better shown in FIG. 2. An end transverse bar 13 merging with the side flanges 12, 12 to define the tapered end 11*b* of the buckle body 11 is spaced from a fixing bar 14 to allow one end of a belt B to pass between the bar 13 and the bar 14 and wrap around the bar 14, the belt B being fastened normally permanently by sewing or other suitable means as at S.

A first anchoring bar 15 is disposed remote from the tapered end 11*b* with its arcuate surface 15*a* lying short of the upper surface of the flange portions 12, 12. The first anchoring bar 15 is recessed to provide a first sharp corner 15*b* directed towards the thickened end 11*a* of the buckle body 11 and a second sharp corner 15*c* directed towards the tapered end 11*b*.

A second anchoring bar 16 is disposed below the first anchoring bar 15 with a lower surface 16*a* lying substantially flush with the lower surface of the flange portions 12, 12 and joining with an upper surface 16*b* to provide a relatively obtuse corner 16*c*.

Figure 2:
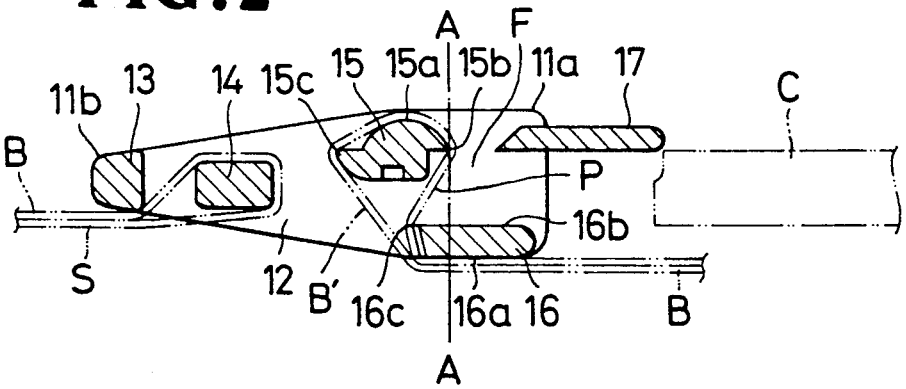
FIG. 2 is a cross-sectional view taken generally along the line II—II of FIG. 1.

According to an important aspect of the invention, the first and second anchoring bars 15 and 16 are held in spaced partially superimposed relation to each other with the obtuse corner 16*c* of the second bar 16 protruding into the region of the first bar beyond a vertical axial line A—A passing in contact with the sharp corner 15*b* of the first bar 15 perpendicularly to the longitudinal plane of the buckle body 11, so that there is defined a path P extending in a substantially cross-sectional "Z"-like configuration between the first and second anchoring bars 15 and 16 as indicated by the phantom line in FIG. 2.

With this construction, the belt B is trained with its free end portion B' around the second sharp corner 15*c*, up around the the arcuate upper surface 15*a*, down around the first sharp corner 15*b*, around the obtuse corner 16*c* and pulled under the lower surface 16*a* for a distance required to achieve a desired length adjustment of the belt B, in which instance the letter "Z" path defined by the upper surface 15*a* and first sharp corner 15*b* of the first bar 15 and the obtuse corner 16*c* and lower surface 16*a* of the second bar 16 functions to ensure firm anchoring of the belt B as adjusted within the buckle body 11.

According to another important aspect of the invention, the second anchoring bar 16 has its upper surface 16*b* formed substantially horizontally flat and parallel to the longitudinal plane of the buckle body 11 to provide a free space F between the first corner 15*b* of the first bar 15 and the upper surface 16*b* of the second bar 16, such free space F being advantageously utilized for the insertion of a side molding core C during molding operation.

Designated at 17 is a transverse end bar attached to the thickened end of the buckle body 11 and serving as a handle on one hand and as a cover on the other to conceal the interior of the buckle body 11 to render the appearance of the buckle 10 attractive.

Figure 3:
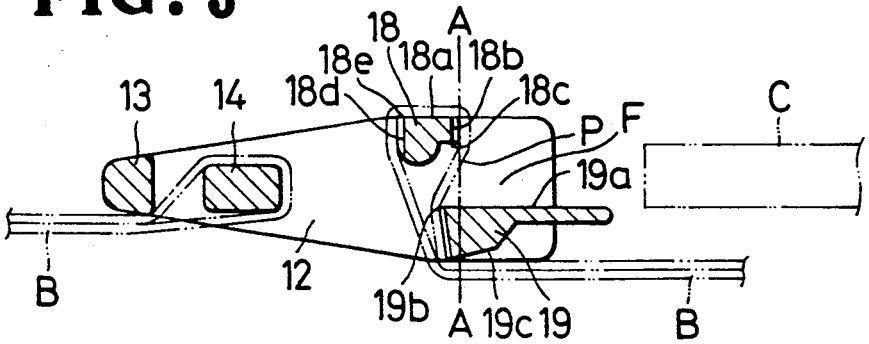
FIG. 3 is a view similar to FIG. 2 but showing a modified portion.

FIG. 3 illustrates a modification of the buckle 10 described above and shown in FIGS. 1 and 2, the modification being directed to a first anchoring bar 18 having a flat upper surface 18*a* and a first vertical face 18*b* defining therebetween a first corner 18*c* and a second vertical face 18*d* defining with the upper surface 18*a* a second corner 18*e*, and also directed to a second anchoring bar 19 having a flat upper surface 19*a*, a handle 20 as an extension thereof, an obtuse corner 19*b* and an upwardly inclined lower surface 19*c*. The modification, despite these structural changes, provides a function similar to the first advanced embodiment.

FIGS. 4 through 9 inclusive are illustrative of a second embodiment of the invention and utilized to explain the manner in which the desired "Z"-like belt path P is formed by the use of various auxiliary attachments provided separately from the buckle body. Throughout these figures only those parts which participate in the formation of the "Z"-like path P will be described with other parts of the buckle omitted from explanation for purposes of brevity.

Figure 4:
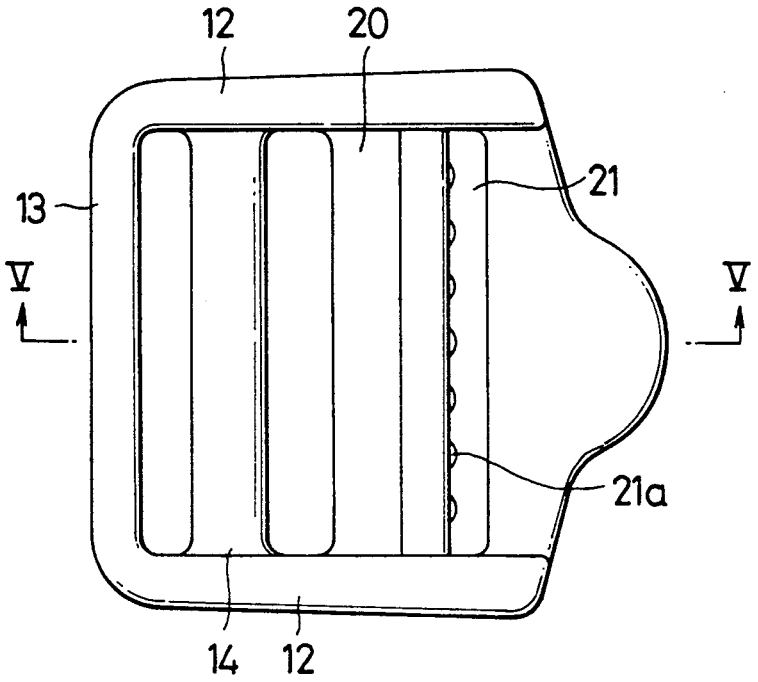
FIG. 4 is a plan view of a buckle according to a second embodiment of the invention.
Figure 5:
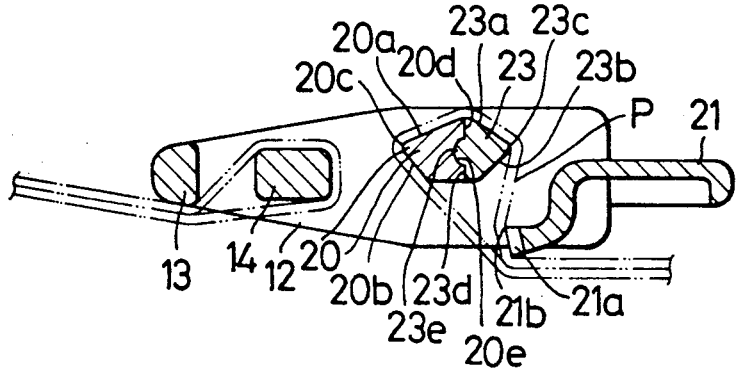
FIG. 5 is a cross-sectional view taken generally along the line V—V of FIG. 4.

As shown in FIGS. 4 and 5, a first anchoring bar 20 has an upper inclined surface 20*a* and a lower inclined surface 20*b* defining therebetween a sharp corner 20*c* and a vertical surface 20*d* having formed therein a transversely of the buckle body 11.

A second anchoring bar 21 formed integrally with a horizontally extending handle 22 is provided with a series of transversely spaced notches 21*a* for engagement with the belt B and has a corner 21*b* around which the belt B is trained.

A auxiliary attachment 23 is formed substantially symmetric to the first anchoring bar 20 and has an upper surface 23*a* and a lower surface 23*b* defining therebetween a sharp corner 23*c* and a vertical surface 23*d* having formed thereon a transverse ridge 23*e*. This attachment 23, which is a separate piece prior to assembly on the buckle body, is joined with the first anchoring bar 20 by snapping the ridge 23*e* into the groove 20*e*, when the corner 23*c* of the attachment 23 lies across and projects into the region of the second bar 21 thereby establishing the "Z"-like path P along which the belt B is trained and secured in place after adjustment.

Figure 6:
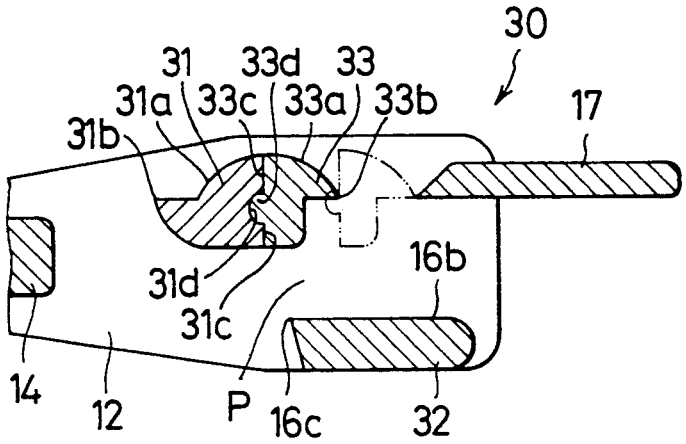
FIGS. 6–9 inclusive are cross-sectional views of respective variations of the second embodiment of the invention.

A variation of the second embodiment of the invention is shown in FIG. 6 in which a buckle 30 comprises a first anchoring bar 31 having an arcuate upper surface 31*a* merging into a sharp corner 31*b* and a vertical surface 31*c* having formed therein a transverse groove 31*d*. A second anchoring bar 32 is similar in construction to the bar 16 shown in FIG. 2.

An auxiliary attachment 33, initially separate from the buckle body, has an arcuate upper surface 33*a* merging into a corner 33*b* and a vertical surface 33*c* with a transverse ridge 33*d* formed thereon for engagement with the mating groove 31*d* in the first anchoring bar 31. With the attachment 33 engaged with the first bar 31, the first bar 31 and the second bar 32 are disposed in partially superimposed relation to each other thereby establishing the "Z"-like belt path P.

Figure 7:
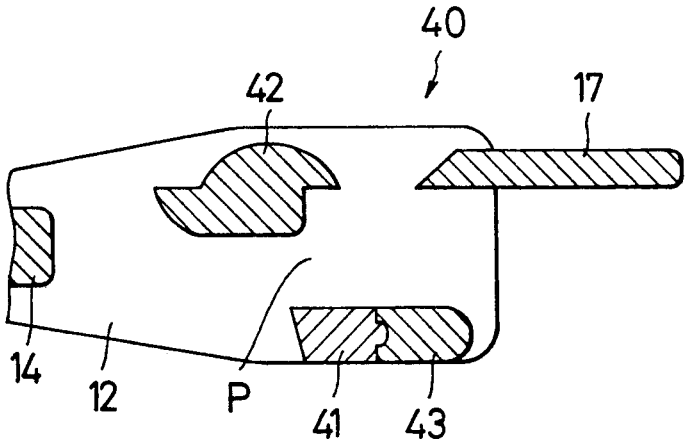

FIG. 7 shows another variation of the second embodiment of the invention in which a buckle 40 is substantially similar in construction to the buckle shown in FIG. 6 except that an auxiliary attachment 41 is adapted for engagement with a second anchoring bar 43, while a first anchoring bar 42 is a solid piece.

Figure 8:
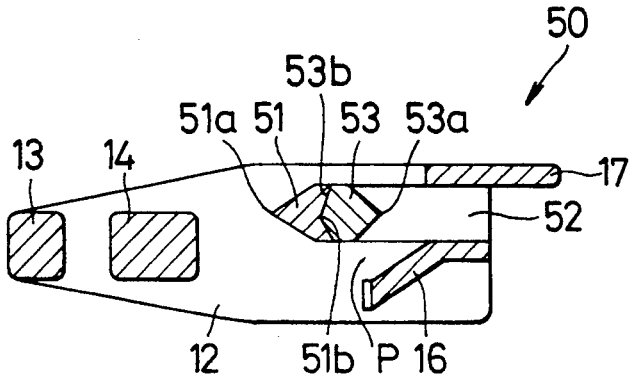

FIG. 8 shows further modification of the second embodiment of the invention in which a buckle 50 comprises a first anchoring bar 51 having a sharp corner 51*a* directed forward to the tapered end of the buckle body and an indent 51*b* disposed opposite to the corner 51*a*. A guide slot 52 is provided for inserting therethrough an auxiliary attachment 53 which has a sharp corner 53*a* directed toward the thickened end of the buckle body and a projection 53*b* complimentary in shape for fitting engagement with the indent 51*b* of the first anchoring bar 51.

Figure 9:
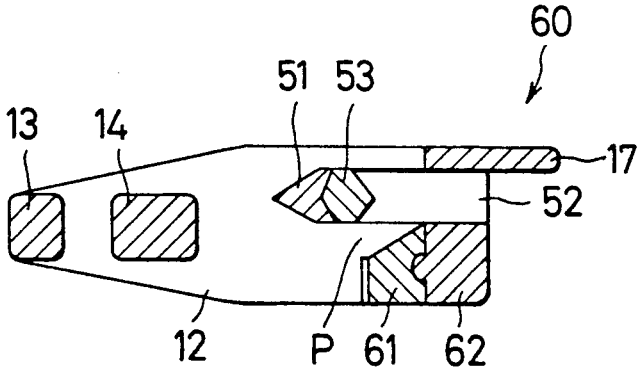
Figure 10:
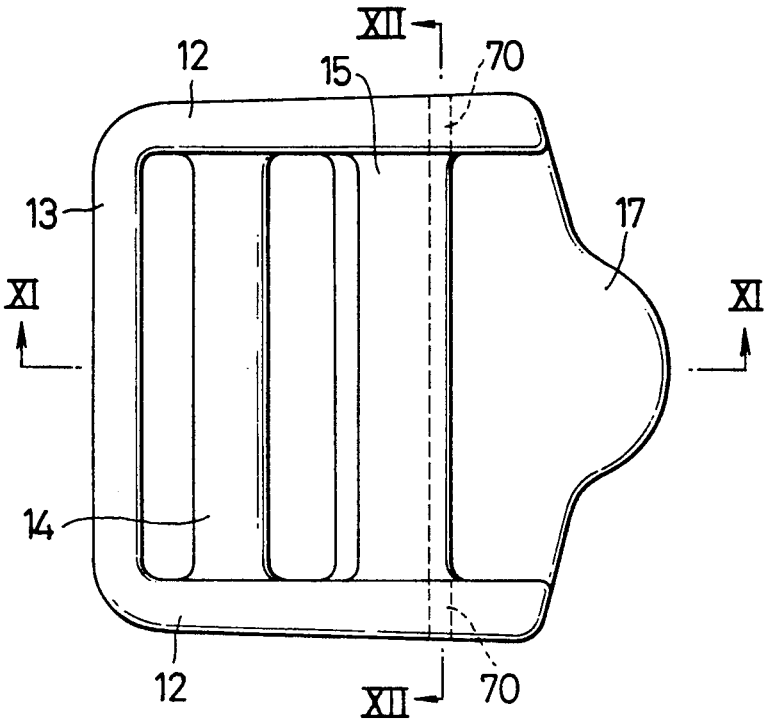
FIG. 10 is a plan view of a modified form of a buckle embodying the invention.
Figure 11:
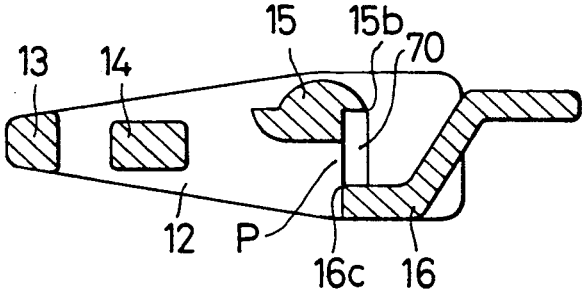
FIG. 11 is a cross-sectional view taken generally along the line XI—XI of FIG. 10.
Figure 12:
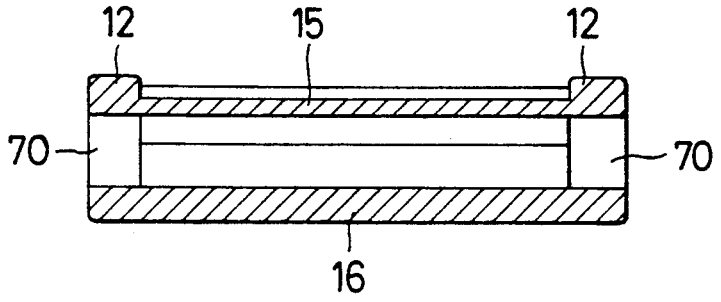
FIG. 12 is a cross-sectional view taken generally along the line XII—XII of FIG. 10.
Figure 13:
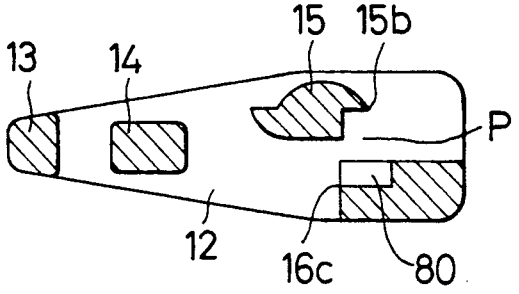
FIG. 13 is a cross-sectional view of another modified form of buckle.

FIG. 9 shows still another variation of the second embodiment of the invention which shows a buckle 60 similar to that of FIG. 8 but features the provision of an additional auxiliary attachment 61 for engagement with a second anchoring bar 62.

FIGS. 10–16 inclusive show a third embodiment of the invention which is characterized by the formation of the "Z" belt path P by means of a through-opening 70. This through-opening extends transversely across the side flange portions 12, 12 and between the first anchoring bar 15 and the second anchoring bar 16, defining therebetween a rectangular cross-over zone at which these bars 15 and 16 are held in vertically spaced, partially superimposed relation to each other, whereby the belt B is led along a substantially "Z"-like path extending between the corners 15*b* and 16*c* of the respective bars.

Figure 14:
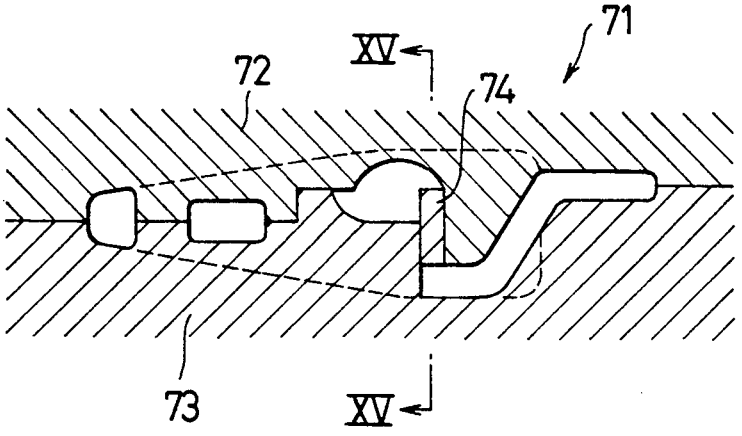
FIG. 14 is a diagrammatic sectional view of a mold.
Figure 15:
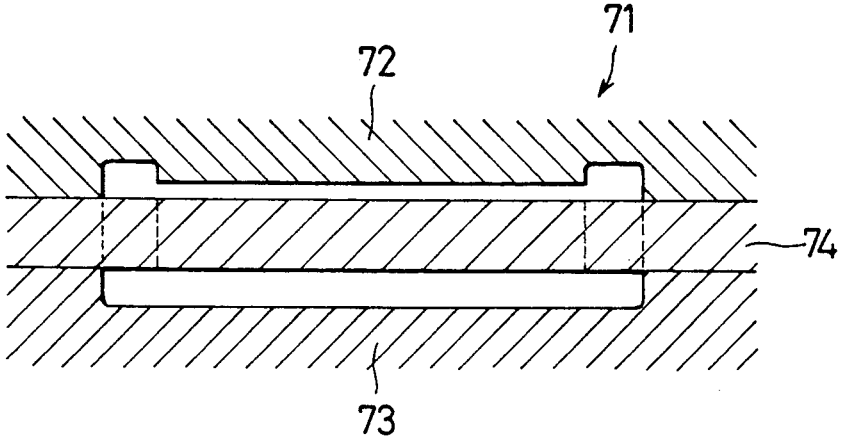
FIG. 15 cross sectional view taken generally along the line XV—XV of FIG. 14.

The through-opening 70 is conveniently formed upon molding of the buckle by molding device 71 shown in FIGS. 14 and 15 which comprises an upper mold 72 and a lower mold 73 having respective shaping cavities, in which there is provided a side for 74 releasably mounted for shaping the corresponding through-opening 70.

Figure 16:
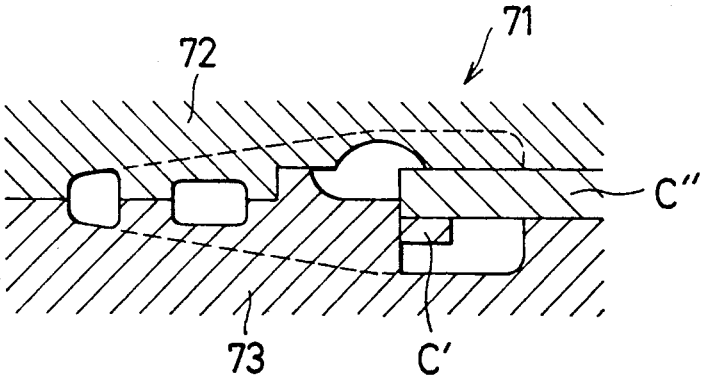
FIG. 16 is a diagrammatic sectional view of another mold.

A modified form of through-opening 80 is shown in FIG. 3 which extends transversely across the side flange portions 12, 12 to define a stepped recess 81 in the second anchoring bar 16 thereby establishing the "Z" path P between the corners 15*b* and 16*c* of the two bars 15 and 16. This through-opening 80 is formed by a corresponding shaped side core C, mounted transversely across the mold 70, in which instance an additional side core C″ is used to fill the space between the corners 15*b* and 16*c* of the respective bars 15 and 16, the core C″ being inserted longitudinally of the buckle body in a direction traversing the core C′ as shown in FIG. 16.

FIGS. 17–22 inclusive illustrate a fourth embodiment of the invention which, like the previously described embodiments, ensures the formation of the "Z" path P for firmly securing the belt B in place therealong.

Figure 17:
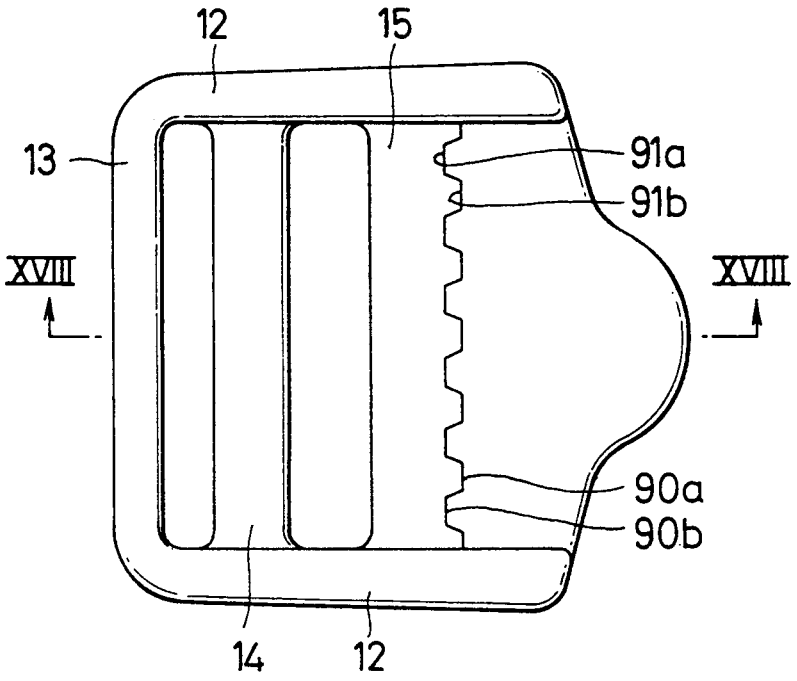
FIG. 17 is a plan view of a further modified form of a buckle of the invention.
Figure 18:
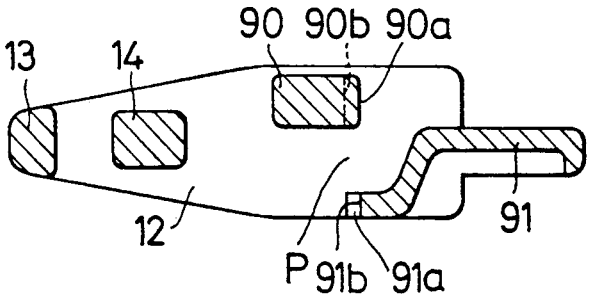
FIG. 18 is a cross sectional view taken generally along the line XVIII—XVIII of FIG. 17.

The buckle shown in FIGS. 17 and 18 comprises a first anchoring bar 90 having alternate ridges 90*a* and grooves 90*b* extending along one edge facing the thickened end of the buckle body 11 and a second anchoring bar 91 having alternate ridges 91*a* and grooves 91*b* extending along one edge facing the opposite tapered end of the buckle body 11. The ridges 90*a* and grooves 90*b* of the first bar 90 are positioned in spaced superimposed relation to the grooves 91*b* and ridges 91*a* of the second bar 91 so that the ridges and grooves of the respective bars appear inter-engaged as viewed from above and thus define a substantially "Z"-like path therebetween for the passage of the belt B. The buckle having such ridge and groove arrangement may be conveniently fabricated by a molding device 100 shown in FIGS. 21 and 22 which includes four separable molds 100*a*–100*d* with ridge and groove forming portions 100*e* and 100*f*.

Figure 19:
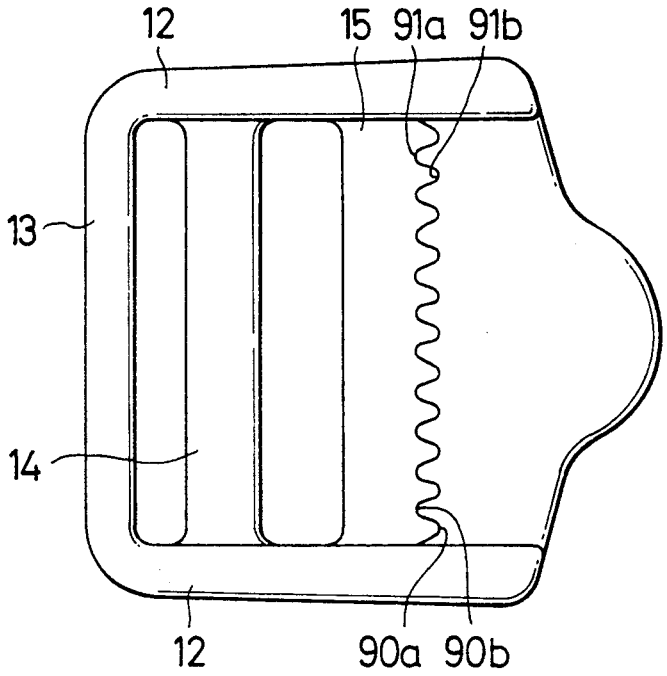
FIG. 19 is a plan view of still another modified form of a buckle of the invention.

A variation of the fourth embodiment shown in FIG. 19 differs from that of FIGS. 17 and 18 in that the ridges and grooves of the respective first and second bars 90 and 91 jointly define a wave-like formation.

Figure 20:
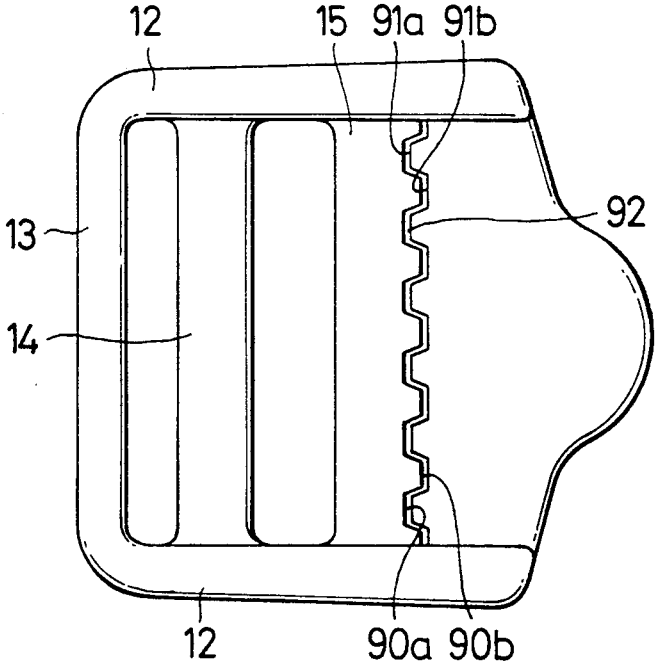
FIG. 20 is a plan view of a still further modified form of a buckle of the invention.
Figure 21:
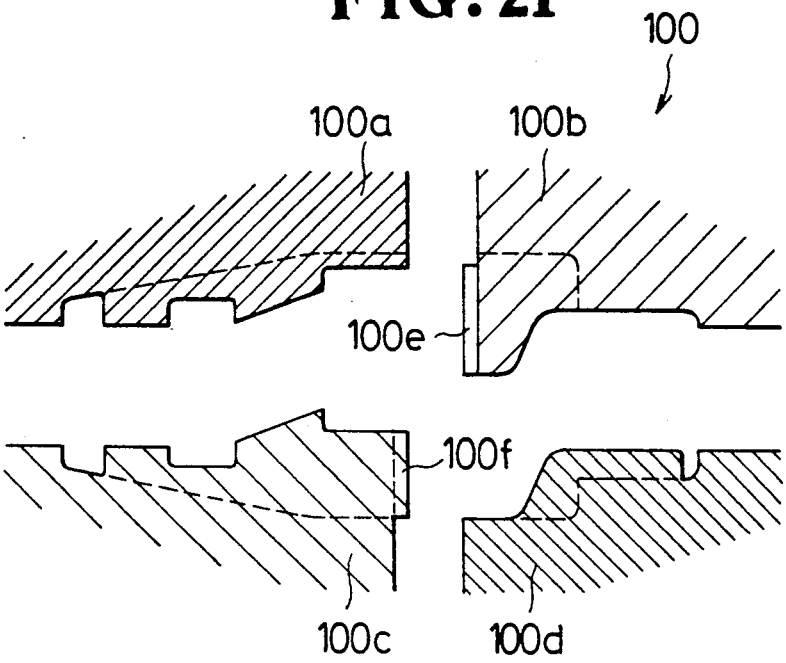
FIGS. 21 and 22 are diagrammatic sectional views of another set of molds.
Figure 22:
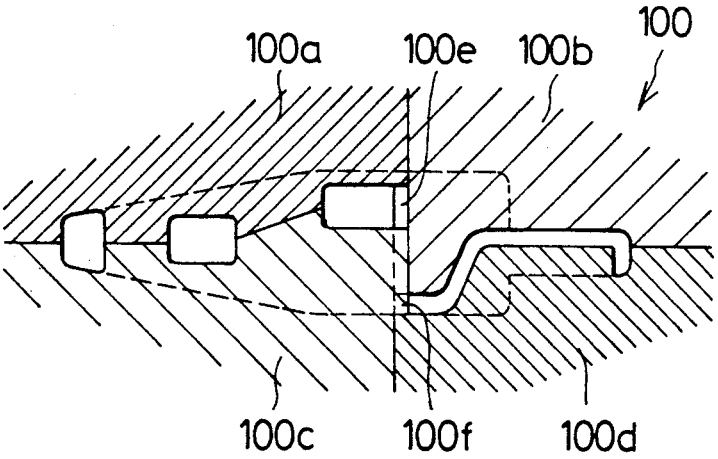

Another variation shown in FIG. 20 differs from that of FIGS. 17 and 18 in that the ridges and grooves of the first bar 90 are spaced across a gap 92 from the mating ridges and grooves of the second bar 91.

These variations of the fourth embodiment may be formed by slightly modifying the mold 100 as appears apparent to one skilled in the art.

Obviously various modifications and variations of the present invention are possible in light of the above teaching. It is, therefore, to be understood that within the scope of the appended claims the invention may be practiced otherwise than as specifically described.

What is claimed is:

1. A buckle for adjustably securing a belt or the like which comprises a generally frame-like body defined by side flange portions interconnect by a plurality of bars extending in parallel spaced relation transversely of said body, an end transverse bar connected to one end of said flange portions for securing one end of the belt a first anchoring bar having a first anchoring portion directed towards said one end of said body and a second anchoring bar having a second anchoring portion, said first and second anchoring bars being held in spaced partially superimposed relation to each other with said second anchoring portion of said second anchoring bar extending into the region of said first anchoring bar beyond a vertical axial line passing in contact with said first anchoring portion of said first anchoring bar perpendicularly to the longitudinal plane of said body, thereby establishing a substantially cross-sectional "Z"-like path for wrapping the belt therearound at the opposite end of the buckle.

2. A buckle according to claim 1 wherein said second anchoring bar has its upper surface formed substantially flat and parallel to the longitudinal plane of the buckle to provide a free space between said first anchoring bar and said second anchoring bar.

3. A buckle according to claim 1 wherein said buckle body has a through-opening extending transversely across said side flange portions between said first anchoring bar and said second anchoring bar.

4. A buckle according to claim 1 wherein said first anchoring bar and said second anchoring bars have transversely extending alternate ridges and grooves.

5. A buckle according to claim 1 wherein said buckle body is formed from a plastic material.

6. A buckle according to claim 1 wherein said first and second anchoring portions are aligned on said vertical axial line.

7. A buckle for adjustably securing a belt or the like which comprises a generally frame-like body define by side flange portions interconnected by a plurality of bars extending in parallel spaced relation transversely of the said body, an end transverse bar connected to one end of said flange options for securing one end of the belt, a first anchoring bar having a first anchoring portion directed towards said one end of said body and a second anchoring bar having a second anchoring portion, said first and second anchoring bars being held in spaced partially superimposed relation to each other with said second anchoring portion of said second anchoring bar extending into the region of said first anchoring bar beyond a vertical axial line passing in contact with said first anchoring portion of said first anchoring bar perpendicularly to the longitudinal plane of said body, thereby establishing a substantially cross-sectional "Z"-like path for wrapping the belt therearound at the opposite end of the buckle wherein said first anchoring bar has a transversely extending groove directed towards said one end of said body for engagement with a transversely extending ridge on an auxiliary attachment to establish said "Z"-like path.

8. A buckle according to claim 7 wherein said auxiliary attachment is adapted for engagement with said second anchoring bar.

* * * * *

UNITED STATES PATENT AND TRADEMARK OFFICE

CERTIFICATE OF CORRECTION

PATENT NO. : 5,307,542

DATED : May 3, 1994

INVENTOR(S) : Ryukichi Murai

It is certified that error appears in the above-indentified patent and that said Letters Patent is hereby corrected as shown below:

On the cover page, item 75 Inventor, replace the first name of the inventor with --RYUKICHI--.

Signed and Sealed this

Thirtieth Day of August, 1994

*Attest:*

Bruce Lehman

BRUCE LEHMAN

*Attesting Officer*

*Commissioner of Patents and Trademarks*